United States Patent [19]

Garner et al.

[11] Patent Number: 4,559,771

[45] Date of Patent: Dec. 24, 1985

[54] MANUFACTURE OF TELECOMMUNICATIONS CABLE CORE UNITS

[75] Inventors: John N. Garner, Kingston; Philip A. McGettigan, Montreal, both of Canada

[73] Assignee: Northern Telecom Limited, Montreal, Canada

[21] Appl. No.: 637,592

[22] Filed: Aug. 3, 1984

[51] Int. Cl.[4] ..... H01B 13/04

[52] U.S. Cl. ..... 57/6; 57/352

[58] Field of Search ..... 57/3, 6, 9, 314, 352, 57/361, 908

[56] References Cited

U.S. PATENT DOCUMENTS

| | | | |
|---|---|---|---|
| 3,187,495 | 6/1965 | Christian | 57/314 X |
| 3,412,544 | 11/1968 | Sugi et al. | 57/6 X |
| 3,775,955 | 12/1973 | Shah | 57/293 |
| 4,151,704 | 5/1979 | Spicer et al. | 57/361 X |
| 4,429,520 | 2/1984 | Garner et al. | 57/314 X |

*Primary Examiner*—Donald Watkins

*Attorney, Agent, or Firm*—R. J. Austin

[57] ABSTRACT

Changing relative positions of conductor pairs along a telecommunications cable core by passing the pairs as they approach a core unit forming means, in an array through a flow of air which causes relative sideways movement of the pairs and continual change in their positions. The array may be arcuate, conveniently circular, and the airflow moves outwardly from within the array. Alternatively, the array is primarily planar with the airflow moving from one side of the array.

32 Claims, 11 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of twisted units of conductors, each unit conventionally being a twisted pair of conductors. A core may be formed as a single core unit of twisted pairs, e.g. 50 or 100 pairs, or larger cores, i.e. up to 3,600 twisted pairs, comprises a plurality of core units. The twisted pairs are stranded together to form a core unit with the conductors of each pair twisted toegether with a predetermined lead to the twist, i.e. the distance taken along the pair for each conductor to complete a single revolution along its path. This distance will be referred to in this specification as the "twist lay" of a pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is to attempt to maximize the communications performance of the cable, e.g. to lessen pair-to-pair and pair-to-ground capacitance unbalance, to reduce crosstalk between pairs and to lower the coefficient of deviation of mutual capacitance between pairs.

In a conventional core unit, the twisted conductor pairs retain their positions relative to other pairs, within certain limits. However, it is recognized that the pair-to-pair capacitance unbalance and crosstalk between pairs is dependent to a large degree upon the distance of the two pairs from one another. To reduce the pair-to-pair capacitance unbalance and to reduce crosstalk, suggestions have been made to move the conductor pairs relative to one another as they progress towards a stranding machine for stranding them into a core unit so that in the finished core unit, the conductor pairs change in relative positions and distances apart. In a suggested method for changing the relative positions of conductor pairs as they move towards the stranding machine, the conductor pairs enter a guide arrangement which comprises a system of horizontal guides movable horizontally and located in vertically tiered fashion. The pairs are distributed throughout the tiers and relative horizontal movement of the guides changes the relative positions of the pairs as they move downstream. This method was first suggested by Sigurd Norblad of Telefonaktiebolaget LM Ericsson, in a paper entitled "Capacitance Unbalance Telecommunications Networks" read before the International Wire and Cable Symposium in 1971. The method involves the use of sideways physical forces upon conductor pairs and this could render it unsuitable for use on conductors insulated with pulp which is sensitive to the degree of surface pressures which are inherent with such forces.

The present invention concerns a method and apparatus for making core units involving changing the relative positions of conductor units before they are brought together to form a core unit and in which the high degree of surface pressures of previous apparatus is avoided.

Accordingly, the present invention provides an apparatus for forming a core unit from telecommunications conductor units, each formed from twisted together insulated conductors, and in which the relative positions of the conductor units are changed along the core unit, the apparatus comprising in order, downstream along a feedpath for the units:

means to guide conductor units in the form of an array in a cross-section transverse to the feedpath;

means to introduce a flow of air through the array at an airflow station spaced downstream from the array guide means so as to cause relative sideways movement of the conductor units and continual change in their positions in the array relative to their positions at the array guide means; and a core unit forming and take-up means to draw the conductor units together to form a core unit.

In the apparatus according to the invention, the array guide means may be provided to provide, for instance, an array of arcuate or substantially planar configuration. When an arcuate array is to be formed, the air introducing means preferably is located to introduce the airflow from a position at or towards the center of curvature of the array.

Relative movement of conductor units affects their relative positions in a completed core unit. To further randomize their positions and change in positions, it is advantageous to provide a means for directing a further flow of air across the conductor units, this further means disposed between the air introducing means and the core unit forming and take-up means. This further means should operate to direct air in a direction generally opposite from that of the air introducing means. Thus, when the conductor units are in arcuate array, the further airflow directing means acts to move conductor units towards one another and to collapse the array.

The apparatus may also have a tension reducing means to reduce tension in conductor units below that upstream of the tension reducing means to enable airflow through the array to move the conductor units and change their relative positions.

The invention also includes a method of forming a core unit from telecommunications conductor units each comprising twisted together insulated conductors and in which the relative positions of the conductor units are changed along the core unit, the method comprising:

passing the separate conductor units along the feedpath and guiding the units through guide means in an array in a cross-section transverse to the feedpath before the conductor units pass through an airflow station;

passing the conductor units through the airflow station in their array and subjecting them to the influence of a flow of air through the array at the station, the flow of air effecting relative sideways movement of the conductor units and constant change in their positions in the array relative to their positions at the guide means; and forming the conductor units in their constantly changing positions into the core unit, the relative positions of the conductor units in the core unit at any position along the lengths thereof influenced by the relative positions of the conductor units as they are drawn into the forming and take-up means.

Embodiments of the invention will now be described by way of example, with reference to the accompanying drawings, in which.

Figure 1:
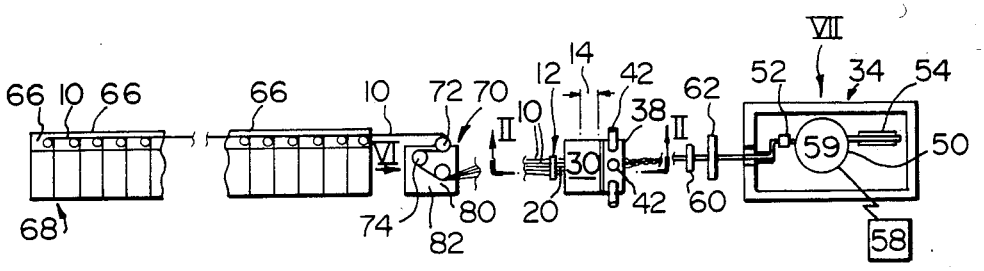
FIG. 1 is a side elevational view of an apparatus according to a first embodiment.
Figure 2:
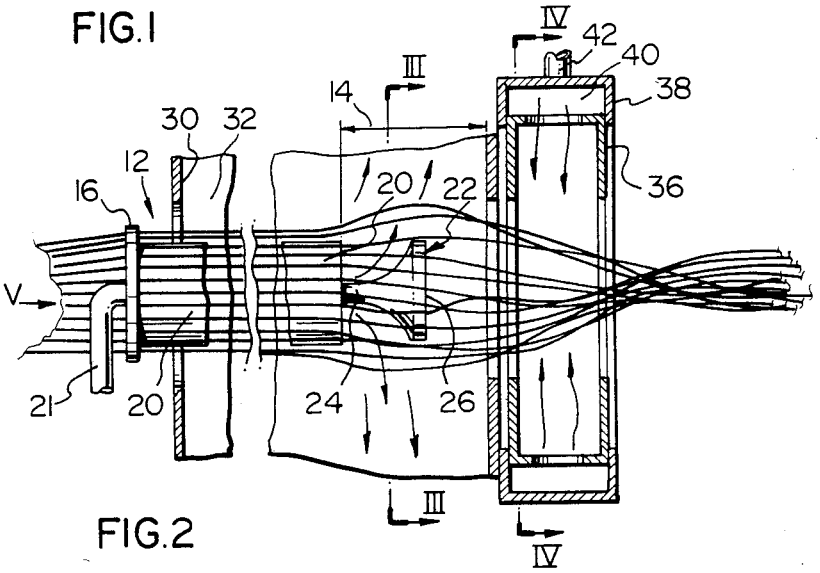
FIG. 2 is a cross-sectional view on larger scale through the apparatus of FIG. 1 taken along lines II—II in FIG. 1.
Figure 5:
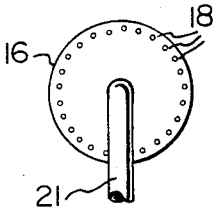
FIG. 5 is a view in the direction of arrow V in FIG. 2.
Figure 6:
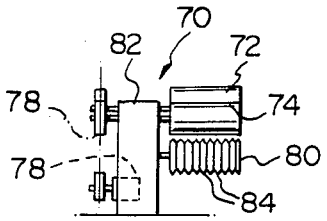
FIGS. 6 and 7 are views taken in the direction of arrows VI and VII, respectively, in FIG. 1.

As shown by FIG. 1, apparatus for forming a core unit from conductor pairs 10 of twisted together conductors comprises a means 12 to form and guide the pairs in an arcuate array towards an airflow station 14. The array guide means 12 comprises a circular guide plate 16 (see FIG. 2), formed with twenty-five guide holes 18 for guiding twenty-five conductor pairs in the array during the formation of a twenty-five pair core unit, as will be described. As shown by FIG. 5, the guide holes 18 are substantially equally spaced apart around a pitch circle close to the periphery of the guide plate 16 so as to form the array in substantially circular configuration. The distance between the guide plate 16 and the airflow station 14 is substantial, so that when conductor pairs are moved relatively to each other in the station 14 then there is little or no resistance to such movement by the location on the conductor pairs within the guide holes 18. The distance in this embodiment between the guide plate 16 and the airflow station is approximately 1 meter. An arcuate surface means is disposed between the guide plate 16 and the airflow station to maintain the conductor units in their circular array as they move towards the airflow station. As shown by FIGS. 1 and 2, this arcuate surface means comprises a hollow cylinder 20 which is secured to the guide plate 16 and extends downstream from it.

Figure 3:
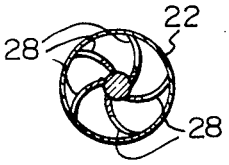

The inside of the cylinder 20 is provided to apply a flow of air from an air pressurized source through an air supply pipe 21 which is secured coaxially into the upstream end of the guide plate and cylinder. The downstream end of the cylinder 20 lies at the commencement to the airflow station 14. At the airflow station, a means is provided to introduce a flow of air through the array of conductor pairs so as to cause relative sideways movement of the pairs and continually change their positions in the array relative to their positions as they pass through the guide plate 16. The means for introducing the air comprises an air diffuser 22 which has a shaft 24 by which it is rotatably mounted within the downstream end of the cylinder. The diffuser 22, as shown by FIGS. 2 and 3, has a downstream end plate 26 of larger diameter than the shaft 24. It also has vane means comprising a plurality of curved vanes 28 (FIG. 3) which extend outwardly from the shaft towards the end plate and increase their diameter as they approach the end plate. The distance between the end plate and the downstream end of the cylinder is sufficient to ensure that any airflow from between the vanes 28 and the end of the cylinder places sufficient load upon conductor pairs to cause their movement across the feedpath while minimizing pressure upon them. Minimal pressure is important as excessive pressure may damage some insulation, for instance pulp insulation, which is easily compressed even under small pressure conditions. In this case, the minimum distance between the cylinder and the end plate 26 is about 16 centimeters for a flow of air through the end of the cylinder of between 60 to 70 miles per hour to cause movement of conductor pairs.

Surrounding the end of the cylinder 20 and the air diffuser 22 is an annular housing 30, which has a substantially continuous inner opening 32 for withdrawing the air as it flows from between the diffuser and the cylinder and across the conductors. The housing forms the dual purpose of taking the air to exhaust and also assists in sound insulating the apparatus to reduce the sound created by the passage of air.

Figure 4:
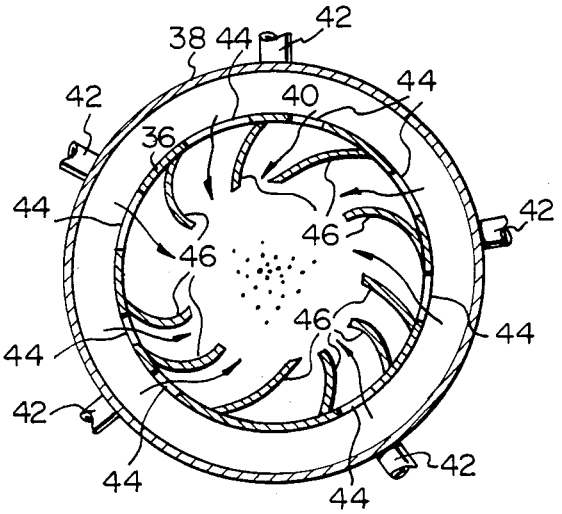
FIGS. 3 and 4 are cross-sectional views along lines III—III and IV—IV in FIG. 2.

Immediately downstream from the housing 30 is disposed a means for directing a further flow of air across the array of conductor units, i.e. in directions towards the centre of the array, so as to assist in relatively moving the units and also the commence movement of the units towards one another as they approach a core unit forming and take-up means 34, which will be described. The means for directing the further flow of air comprises a rotatable annular housing 36 which is held within a fixed housing 38, as shown in FIGS. 2 and 4. Between the housings 36 and 38 is defined an annular air chamber 40 which has a plurality of air inlets 42 spaced around its periphery for passing a flow of air into the chamber through the various inlets and from an air pressure source (not shown). Thus, a substantially uniform flow of air is obtained at all of a plurality of outlets 44 formed between the chamber 40 and the rotatable housing 36, so that the airflow through the housing 36 may be substantially constant at all positions. As shown by FIG. 4, the housing 36 is provided with radially extending vanes 46 which are curved so as to direct air passing through the housing 36 and through inner outlets 48 of the housing while also effecting rotation of the housing 36. As shown by FIG. 4, the vanes may be of different configurations so that the various outlets 48 direct the airflow in different directions across the feedpath for the conductor pairs. This produces an assymetric airflow within the housing 36 during its rotation, which completely randomizes the movement of the conductor pairs as they move through that housing.

Figure 7:
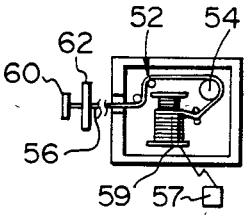

The core unit forming and take-up means 34 is of coventional construction and comprises a stranding machine 50, comprising a flying strander 52 and including a "helper" capstan 54. The "helper" capstan is to assit in the drawing of a core unit 56 into the machine 50, the main force for which is taken by a motor 58 (see FIG. 7) which drives a core unit take-up reel 59. Upstream of the machine 50 is a drawing means in the form of a closing die 60 for drawing the conductor pairs together, and a binding head 62. As the structure is conventional, no further description is required.

It is a requirement of the invention that the tension in the conductor pairs is not excessive so as to resist unduly, or even prevent, their relative movement across the feedpath caused by the airflow from the diffuser 22 or from the housing 36. If the conductor pairs have been twisted in conventional fashion, i.e. by previously twisting the conductors of each pair and reeling it onto a spool and the pairs are then fed from such prepared spools (not shown) upstream, then the tension in the conductor pairs may not be excessive. However, if the conductor pairs are formed from individual conductors by a twisting operation in tandem with the core unit forming operation, then the tension created during the twisting operation upstream is likely to be excessive. In this case, a tension reducing means will be necessary for the operation of the invention.

It is intended that the apparatus of this embodiment should form a part of a larger apparatus in which the twisting of the conductor pairs and the core unit forming operation is performed in tandem. Thus, the conductor pairs 10 are twisted together by twenty-five twisting machines 66, which are disposed in a single straight bank 68 of the machines. Each twisting machine 66 is of conventional construction (not shown) and comprises, in conventional manner, a reel cradle for holding, in rotatable fashion, two reels of individually insulated conductors to enable the conductors to be drawn from the reels under the drawing influence of the stranding machine 50. Each machine comprises either a single flyer in conventional manner, or may comprise two flyers and associated pulleys to provide a balanced rotational structure such as is described in a copending patent application entitled "Twisting Machine", filed Dec. 27, 1983 in the names of J. Bouffard, A. Dumoulin and E. D. Lederhose under U.S. application Ser. No. 565,635. The conductors as they are drawn through the flyer of each machine are drawn together at the top of the machine to be twisted together and are then fed outwardly as a twisted pair 10 from and along the bank 68 of machines, as shown in FIG. 1.

As already indicated, because the twisting and core unit standing operation is performed in tandem, then a tension reducing means is necessary. The tension reducing means of this embodiment is of the construction described in a U.S. patent application Ser. No. 565,634, filed Dec. 27, 1983, entitled "Forming Cable Core Units" in the names of J. Bouffard, A. Dumoulin and M. Seguin. The tension reducing means 70 comprises two drivably rotatable cylinders 72 and 74 around each of which the conductor pairs pass on the way to the guide plate 16. The two cylinders are of substantially equal diameter and have a common drive in the form of a drive motor 76 which is connected to the cylinder 72 by drive belt 78. A drive belt (not shown) also drivably connects the two cylinders together. The drive motor 76 is electrically influenced by the line speed to provide a peripheral speed to each of the cylinders 72 and 74 which is slightly in excess of the drawing speed of the conductor pairs into the stranding machine. The degree of this excess in speed is subject to choice dependent upon design, but in this particular machine lies between one and five percent and is preferably in the region of three percent. It is of importance to realize that the two cylinders 72 and 74 are not a capstan drive and do not operate in the accepted sense for drawing twisted pairs of conductors through apparatus in cable manufacture. As described in the aforementioned application, Ser. No. 565,634, the cylinders 72 and 74 do not engage each of the conductor pairs along a sufficiently long arc of contact to provide enough frictional grip to draw the pairs from the twising machines 66 without the assistance of tension upon the pairs downstream of the cylinders and as provided by the rotation of the reel 59. Hence, if the stranding machine were omitted, the cylinders 72 and 74 would be incapable of drawing conductor pairs 10 from the twisting machines. Additional frictional grip between the cylinders and the conductor pairs is created by tension downstream of the cylinders pulling the pairs down into the cylinder surfaces. While this tension is maintained, the cylinders will draw the conductor pairs from the twisting machines with some slippage because of the excess peripheral speed of the cylinders.

If the grip of the cylinders tends to increase the speed of any pair as it passes around them, towards the draw speed into the stranding machine, then the downstream tension from the cylinders decreases and the frictional grip of the pair around the cylinders is lessened. Thus, the cylinders slip to a greater extent upon the conductor pair and there is a decrease in the tendency for further increase in speed of the pair, as caused by the drive of the cylinders. In any event, if the downstream tension from the cylinders drops towards zero in any conductor pair, the cylinders cannot drive that conductor pair around the cylinders at a speed equal to the draw speed of the twisting machine before increase in slippage would prevent this.

In use of the apparatus of the first embodiment, the pairs of conductors are fed from their respective twisting machines 66 and through the tension reducing means 70 towards the guide plate 16. In the tension reducing means 70, each conductor pair passes around the two cylinders 72 and 74, as shown, and then around a guide roller 80 which is freely rotatably mounted upon a strand 82 of the machine and is formed with annular peripheral grooves 84 which space the conductor pairs apart. As the conductor pairs pass around the cylinders 72 and 74, the pull of the stranding machine 50 increases the frictional contact of the pairs against the surface of the cylinders. Although the cylinders are rotating at a peripheral speed which is greater than the throughput speed of the conductor pairs into the stranding machine, their degee of grip upon the pairs is insufficient to draw the pairs from the twisting machine at the peripheral speeds of the cylinders. This is as explained above and in greater detail in above-mentioned U.S. patent application Ser. No. 565,634. Rather, the degree of drive by the cylinders is dependent upon the frictional grip upon them by the conductor pairs, which increases and decreases in proportion to the downstream tension created by the draw of the stranding machine. Hence, the pull by the cylinders upon each pair increases its speed until it approaches that of the draw speed of that pair into the stranding machine sufficiently to reduce the frictional grip of the conductor pair upon the cylinders to remove the driving force. Any slight increase in the downstream tension from the cylinders will improve their driving engagement with the pair, thereby reducing the tension again. It follows that the tension which has built up during twisting of each conductor pair from its machine 66 and during its movement into the tension reducing means (e.g. up to 3 pounds) is reduced on the downstream side to acceptable level (e.g. about 0.5 pounds) for drawing into the stranding machine. More importantly, this reduced tension is acceptable for the purpose of enabling the flow of air, as controlled by the diffuser 22 or the housing 66, to move the conductor pairs in their array relative to each other with substantially no resistance to movement created by tension.

After leaving the tension reducing means 70, the conductor pairs then are fed through the guide holes 18 in the guide plate 16 to form them into their circular array, as shown by FIG. 2. The pairs are then held substantially in this array by guiding support from the cylinder 20 as they approach the airflow station 14. Upon reaching the airflow station, the conductor pairs are subjected to the influence of the airflow issuing from between the rotating diffuser 22 and the end of the cylinder. This air forces each conductor pair radially outwards from its position in the array and also causes sideways displacement of the pairs so that they become intermingled around the diffuser. This is shown in FIG. 2. The air from the diffuser is exhausted through the housing 30, which also controls the movement away from the diffuser of the conductor pairs.

As the intermingled conductor pairs proceed downstream, they are then subjected to the airflow created by the housing 36. The airflow pattern created within the housing 36 by the inwardly directed openings 48 is completely asymmetric and randomized so that the individual pairs are moved in individual and randomized fashion relative to other pairs along this section of the feedpath. Thus, the airflow through housing 36 assists in the intermingling of the pairs. Hence, a continual change in the relative positions of the pairs takes place, not only at the airflow station 14 but also within the housing 36.

The conductor pairs are fed to their relative positions from the housing 36, through the die 60 and into the strander. The relative positions of the pairs, at any instant, as they pass through the closing die are influenced by the relative positions of the pairs as they move from the housing 36. This affects the relative positions and change in positions of the pairs in the completed core unit 56. Hence, in the completed stranded core unit, the conductor pairs change their relative positions to each other in a completely randomized fashion.

Because of the length of the conductor pairs upon which the airflows act, little pressure is required to move the pairs. Thus, the insulation on the conductors of the pairs is not damaged. This is of particular importance in a case where a pulp insulated conductor is being used and which could be damaged by the use of mechanical moving devices which engage the surface of the pulp, i.e. by a crushing effect. Lack of damage to the insulation, of course, ensures that there is no deterioration in electrical properties in the finished cable, e.g. in pair-to-pair and pair-to-ground capacitance unbalance.

The apparatus described in the first embodiment does, therefore, successfully intermingle the pairs of conductors and change their relationship during core unit manufacture so as to lessen pair-to-pair and pair-to-ground capacitance unbalance and to reduce crosstalk. Apart from this, the size of the apparatus itself required for this purpose, i.e. the guide plate 16, cylinder 20 and housings 32, 36 and 38, are relatively small. For instance, in the above example, in a case where the conductor pairs may be formed from 26 AWG insulated conductors, the cylinder 20 need only have a diameter in the region of 0.5 inches and the holes 18 in the guide plate are on a pitch circle slightly greater than this so that the conductor pairs move easily along the peripheral surface of the cylinder. With this diameter of cylinder, an internal diameter of approximately 2 inches is sufficient for the housings 32 and 36, this diameter giving sufficient space from the conductor pairs to move freely under the influence of the airflow during their randomized mixing together. The diameters of the cylinder and the housings do, of course, vary dependent upon the numbers of conductor pairs which are to be formed into a core unit and also upon the gauge of conductor which is being used. For instance, for a 100 pair unit using 19 AWG conductors, it has been found that a cylinder 20 having a diameter of approximately 1 inch will suffice.

Figure 8:
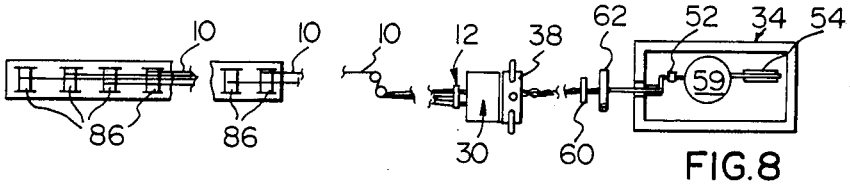
FIG. 8 is a side elevational view of a modification of the first embodiment.

In a modification of the above embodiment, the use of a tension reducing means is unnecessary. As shown in FIG. 8, in the modification in which parts of the apparatus downstream from and including the guide plate 16 are as described in the first embodiment, the previously twisted conductor pairs 10 are fed from reels 86 instead of being formed in tandem with the core unit stranding operation as described above. Little tension is required to pull the conductor pairs from each of the reels and to pass them directly through the guide plate 16, as shown in FIG. 8, after which they are moved relatively to each other and formed into a core unit as described in the first embodiment. It is found that the small tension required to remove them from the reels 86 is insufficient to cause problems in the displacement of the conductor pairs by the flows of air at the station 14 and through the housing 36.

Figure 9:
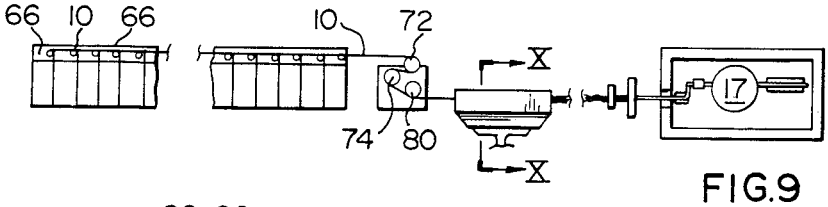
FIG. 9 is a side elevational view of apparatus according to a second embodiment.
Figure 10:
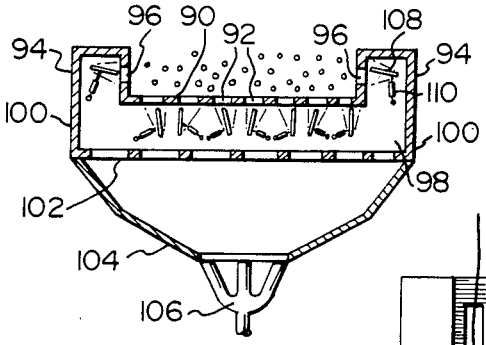
FIG. 10 is a cross-sectional view of the apparatus in FIG. 9, taken along line X—X and on a larger scale.
Figure 11:
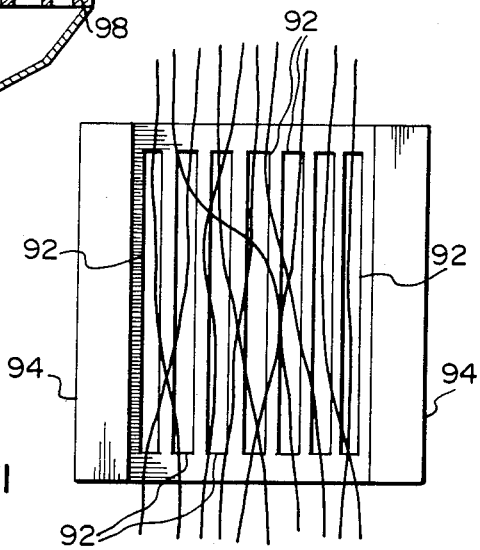
FIG. 11 is a view in the direction of arrow XI in FIG. 10.

A second embodiment is shown in FIG. 9, 10 and 11. In this second embodiment, which is otherwise of the construction described in the first embodiment, the guide plate 16, cylinder 20 and the housings 32 and 36 are replaced with some other means for introducing airflow through the array, which is also of different configuration. As shown in FIG. 9, the means to guide the conductor pairs in the form of an array comprises the guide roller 80 of the tension reducing means. Because of the grooves 84 in the roller, as described in the first embodiment, the conductor pairs are disposed in planar array by the grooves and proceed in this planar array through the airflow introducing means.

The airflow introducing means in this embodiment comprises a flat plate 90 which is disposed beneath the feedpath of the planar array so that the pairs of conductors pass above it, as shown by FIGS. 9 and 10. The plate 90 is formed with air passage means in the form of a plurality of side-by-side longitudinal slits 92, extending along the feedpath to direct an airflow across the array and for a distance to ensure that sufficient load is applied to the conductor pairs to cause their movement, but without sufficient pressure to damage the insulation. The edges 94 of the plate are formed as flanges. Each flange is provided with a slit 96 of similar size and shape to the slits 92. The plate 90 forms one side of a chamber 98, which is also defined by a side and bottom housing member 100 and 102. Pressurized air to cause flow through the slits is provided uniformly throughout chamber 98 from a header unit 104 disposed beneath the chamber, the header unit being supplied with pressurized air through branch inlets 106.

In order to be able to remove the conductor pairs randomly within their planar array, it is desirable for the airflow through each of the slits to be independently changeable in use of the apparatus. To allow for this, the apparatus is provided in this case with a baffle 108 associated with each of the slits, each baffle being pivotally mounted within the chamber 98 and movable by a moving means which will permit its individual movement relative to the other baffles. In this embodiment, the moving means comprises a fluid operated cylinder 110. Each of the cylinders is controlled by an exterior device (not shown), which may be a mechanical device or may be a program controlled computer for moving each of the baffles independently in time and degree of movement from the others between a fully open position or a fully closed position, as shown by the two dotted lines for each of the baffles. The baffles may be disposed at any intermediate position between these two limits so as to control the flow of air, and thus control the affect of the flow of air through each of the slits 92 and 96. Full outline positions of the baffles to produce one certain airflow effect is shown in FIG. 10.

In use of the apparatus of the second embodiment, as the planar array of conductor pairs is fed across the plate 90, the air issuing from the slits 92 and 96 relatively moves conductor pairs both vertically and sideways, thus mixing them at random. Relative movement of the baffles changes the general flow of the air and its randomized pattern above the plate 90 to ensure that, from time to time, the effect upon each conductor pair changes so as to influence the relative positions. To prevent the conductor pairs at the edges of the array from remaining substantially in their original positions during their movement through the apparatus and into the stranding machine, the airflow through the slits 96 (which may be an intermittent airflow) ensures that these conductor pairs move to new positions across the array.

It should be noted that the conductor pairs are not levitated by the air flow which merely applies sufficient force to change relative positions of the pairs. The conductor pairs are held in positions vertically relative to plate 90 by tension between supports upstream and downstream of plate 90. The pairs may be held spaced from plate 90 or may even touch the plate as they move across it. This positioning of the pairs above the plate 90 depends upon the tension applied to the pairs.

We claim:

1. Apparatus for forming a core unit from telecommunications conductor units each formed from twisted together insulated conductors and in which the relative positions of the conductor units are changed along the core unit, the apparatus comprising in order, downstream along a feedpath for the units:- means to guide conductor units in the form of an array in a cross-section transverse to the feedpath;

means to introduce a flow of air through the array at an airflow station spaced downstream from the array guide means so as to cause relative sideways movement of the conductor units and continual change in their positions in the array relative to their positions at the array guide means; and a core unit forming and take-up means to draw the conductor units together to form the core unit.

2. Apparatus according to claim 1 wherein the array guide means is provided to form the array in arcuate configuration.

3. Apparatus according to claim 1 comprising, upstream from the air introducing means, a tension reducing means to reduce tension in the conductor units below that upstream of the tension reducing means to enable airflow through the array to move the conductor units and change their relative positions in the array.

4. Apparatus according to claim 2 wherein the air introducing means is located to introduce the airflow from a position at or towards a center of curvature of the array.

5. Apparatus according to claim 4 comprising an arcuate surface means disposed between the array guide means and the air introducing means to maintain the conductor units in the arcuate array as they move towards the airflow station.

6. Apparatus according to claim 5 wherein the array guide means has unit guides spaced apart around a center to provide the arcuate array substantially in the form of a circle and the arcuate suface means comprises a cylinder having its peripheral surface for maintaining the conductor units substantially in circular array.

7. Apparatus according to claim 4 wherein the air introducing means comprises a passage for the flow of air to the airflow station and an air diffuser at said station to diffuse the air from the passage, outwardly through the arcuate array of conductors.

8. Apparatus according to claim 7 wherein the air diffuser is freely rotatable and has vane means to enable the flow of air to rotate the diffuser as the air passes the vanes.

9. Apparatus according to claim 6 wherein air introducing means comprises a passage for airflow within the cylinder to the airflow station and an air diffuser at said station to diffuse the air from the passage outwardly through the circular array of conductors.

10. Apparatus according to claim 9 wherein the diffuser is freely rotatably mounted upon the cylinder and has vane means to enable the flow of air to rotate the diffuser as the air passes the vane means.

11. Apparatus according to claim 6 provided with an annular housing surrounding the feedpath of conductor units at the airflow station, the housing having an exhaust for airflow after air has passed through the circular array.

12. Apparatus according to claim 6 provided with means for directing a further flow of air across the array of conductor units in directions towards the center of the array so as to assist in relatively moving the conductor units, and to move the units towards one another and out of their arcuate array, the further airflow directing means disposed between the air introducing means and the core unit forming and take-up means.

13. Apparatus according to claim 12 wherein the further airflow directing means comprises an annulus surrounding the feedpath for conductor units, the annulus having air passage means to direct the further airflow from positions around the feedpath and inwardly of the annulus.

14. Apparatus according to claim 13 wherein the annulus is freely rotatable and has vane means to allow the further airflow to rotate the annulus as the air passes the vane means.

15. Apparatus according to claim 1 wherein the guide means is provided to provide a planar array of conductor units.

16. Apparatus according to claim 15 wherein the air introducing means comprises a flat plate disposed beneath the feedpath and passage means through the plate to direct the flow of air upwardly through the feedpath.

17. Apparatus according to claim 16 wherein the passage means comprise a plurality of slits in the plate, the slits extending in the direction of the feedpath.

18. Apparatus according to claim 17 provided with a plurality of baffles beneath the plate, some at least of the baffles individually movable relative to other baffles so as to affect the flow of air through individual slits.

19. Apparatus according to claim 17 wherein flanges extend upwardly from sides of the plate, the flanges formed with air passage means to direct airflow across the feedpath and across the plate.

20. Apparatus according to claim 1 wherein the forming and take-up means comprises drawing means to draw conductor units into and through the forming and take-up means; and the tension reducing means comprises rotatable members disposed along the feedpath for the conductor units, and drive means controlled to drive the rotatable members, said drive means having a drive speed dependent upon the drive speed of the drawing means to ensure that the unrestrained peripheral speed of the rotatable members is in excess of the draw speed of the conductor units into the forming and take-up means, lengths of peripheral surfaces of the rotatable members presented to the feedpaths being insufficient to impart a driven speed to the conductor units above that of the draw speed into the forming and take-up means.

21. Apparatus according to claim 1 wherein the forming and take-up means is a stranding machine.

22. Apparatus according to claim 20 wherein the tension reducing means and the array guide means are in the form of a single unit and the guide means comprises a rotatable guide roller for guiding the conductor units in the array.

23. Apparatus according to claim 22 wherein the guide roller has grooves provided to form a planer array of the conductor units.

24. A method of forming a core unit from telecommunications conductor units, each comprising twisted together insulated conductors, and in which the relative positions of the conductor units are changed along the unit, the method comprising:

passing the separate conductor units along a feedpath and guiding the units through guide means into an array in a cross-section transverse to the feedpath before the conductors pass through an airflow station;

passing the conductor units through the airflow station in their array and subjecting them to the influence of a flow of air through the array at said station, the flow of air effecting relative sideways movement of the conductor units and continual change in their positions in the array relative to their positions at the guide means; and passing the conductor units in their continually changing positions into a core unit forming and take-up means to draw the conductor units together into the core unit, the relative positions of the conductor units in the core unit at any position along the length thereof influenced by the relative positions of the conductor units as they are drawn into the forming and take-up means.

25. A method according to claim 24 wherein the conductor units are fed along the feedpath towards the airflow station while reducing the tension in each conductor unit below that at an upstream position and the flow of air at the airflow station is assisted by reduction in tension in the conductor units to effect the relative sideways movement of the conductor units and continually change their positions.

26. A method according to claim 24 wherein the array is arcuate and the airflow at the airflow station is introduced through the array from a position at or towards a center of curvature of the array.

27. A method according to claim 25 wherein the conductor units are formed into an array of substantially circular configuration and conductor units are maintained in this array by passing them along a cylindrical surface as they approach the airflow station.

28. A method according to claim 27 wherein the air is diffused at the airflow station to pass through the substantially circular array.

29. A method according to claim 28 wherein, downstream from the airflow station, the method comprises subjecting the conductor units to a further airflow which passes across the array in directions towards the center of the array to assist in relatively moving the conductor units and to move the conductor units towards one another and out of their circular array as they approach the core unit forming and take-up means.

30. A method according to claim 29 comprising directing the further airflow from a plurality of directions through the array from air passage means in an annulus surrounding the feedpath for the conductor units.

31. A method according to claim 24 wherein the conductor units are fed in a substantially planar array into the airflow station.

32. A method according to claim 24 wherein the array is planar and the airflow at the airflow station is directed through passage means provided in a planar plate located beneath the array.

* * * * *